US007901521B2

(12) United States Patent
Fujita et al.

(10) Patent No.: US 7,901,521 B2
(45) Date of Patent: Mar. 8, 2011

(54) ALUMINUM BASE ALLOY

(75) Inventors: Masashi Fujita, Saitama (JP); Akihisa Inoue, Miyagi (JP); Hisamichi Kimura, Miyagi (JP)

(73) Assignee: Honda Motor Co., Ltd., Tokyo (JP)

( * ) Notice: Subject to any disclaimer, the term of this patent is extended or adjusted under 35 U.S.C. 154(b) by 287 days.

(21) Appl. No.: 12/057,985

(22) Filed: Mar. 28, 2008

(65) Prior Publication Data

US 2009/0000702 A1 Jan. 1, 2009

(30) Foreign Application Priority Data

Mar. 30, 2007 (JP) ..... 2007-093289

(51) Int. Cl.
*C22C 45/08* (2006.01)

(52) U.S. Cl. ..... 148/403; 148/437; 420/551

(58) Field of Classification Search ..... 148/403
See application file for complete search history.

(56) References Cited

U.S. PATENT DOCUMENTS 5,221,375 A * 6/1993 Nagahora et al. ..... 148/403
5,312,494 A * 5/1994 Horimura et al. ..... 148/437
5,419,789 A * 5/1995 Kita ..... 148/437
5,494,541 A * 2/1996 Fujita et al. ..... 148/561
5,693,897 A * 12/1997 Kita ..... 75/249

* cited by examiner

*Primary Examiner* — George Wyszomierski
(74) *Attorney, Agent, or Firm* — Arent Fox LLP

(57) ABSTRACT

An aluminum base alloy is produced by supercooling a molten alloy composed mainly of aluminum. The molten alloy contains an element capable of forming a quasicrystalline phase, an element which aids formation of the quasicrystals, and an element which stabilizes a supercooled state of the molten alloy and delays crystallization of a crystalline phase, and is composed of a mixed composition of a fine amorphous phase and an aluminum crystalline phase or an aluminum supersaturated solid solution phase, or a single phase of only an amorphous phase.

5 Claims, 6 Drawing Sheets

500nm

100nm

ALUMINUM BASE ALLOY

CROSS-REFERENCE TO RELATED APPLICATION(S)

This application claims the foreign priority benefit under Title 35, United States Code, §119 (a)-(d), of Japanese Patent Application No. 2007-93289 filed on Mar. 30, 2007 in the Japan Patent Office, the disclosure of which is herein incorporated by reference in its entirety.

BACKGROUND OF THE INVENTION

1. Field of the Invention

The present invention relates to an aluminum base alloy composed mainly of aluminum.

2. Description of the Related Art

Conventional aluminum base alloys generally have low hardness and low heat resistance. Though various attempts have been made recently, such as rapidly solidifying a molten aluminum base alloy (hereinafter referred to as "molten alloy") to refine the structure of the alloy so as to improve the mechanical properties (such as mechanical strength) and chemical properties (such as corrosion resistance) of the aluminum base alloy, yet the properties such as strength and heat resistance of the aluminum base alloys obtained in the above manner are not sufficiently improved.

When focusing on nonequilibrium and quasi-periodic structures of the aluminum base alloys produced by a liquid rapid quenching method, there are aluminum base alloys containing amorphous phases and quasicrystalline phases. Such aluminum base alloys are more excellent in mechanical properties and chemical properties than general aluminum base alloys having crystalline phases. Particularly, the aluminum base alloy disclosed in Japanese Published Examined Patent Application No. H05-7459 and the aluminum base alloy disclosed in Japanese Published Examined Patent Application No. H05-32464 contain rare-earth elements and have an amorphous phase or a mixed composition of the amorphous phase and a fine crystalline phase. These aluminum base alloys are excellent not only in strength, heat resistance, and corrosion resistance, but also in workability of bending, etc. Therefore, these aluminum base alloys can be used as high-strength materials and high-wear resistance materials. Incidentally, the fine crystalline phase is a complex composed of a metal solid solution phase formed by an aluminum matrix, an aluminum matrix phase formed by fine crystals, and a stable or metastable intermetallic compound phase.

However, the aluminum base alloys disclosed Japanese Published Examined Patent Application No. H05-7459 and Japanese Published Examined Patent Application No. H05-3246 not only require high cost due to containing expensive high-active rare-earth elements including Y and Ce, etc., but also have low specific strength due to the high specific gravity of the rare-earth elements of Y and Ce, etc.

SUMMARY OF THE INVENTION

An object of the invention is to provide an aluminum base alloy having a reduced specific gravity so that the specific strength thereof can be prevented from being reduced, and having high strength and excellent heat resistance.

An aluminum base alloy according to a first aspect of the present invention is obtained by supercooling a molten alloy composed mainly of aluminum, in which the molten alloy contains an element Q1 capable of forming a quasicrystalline phase, an element Q2 for aiding formation of the quasicrystals, and an element P1 for stabilizing the supercooled state of the molten alloy and delaying crystallization of the crystalline phase, and the aluminum base alloy is composed of a mixed composition of a fine amorphous phase and an aluminum crystalline phase or an aluminum supersaturated solid solution phase, or a single phase of only an amorphous phase.

In such an aluminum base alloy, although the element Q1 capable of forming a quasicrystalline phase exists in the molten alloy, an amorphous phase is more preferentially formed than the quasicrystalline phase. In other words, this aluminum base alloy has a non-quasicrystalline-phase-containing composition that contains substantially no quasicrystalline phase. Herein, "containing substantially no quasicrystalline phase" means that no quasicrystalline phase is observed in analysis using X-ray diffraction.

Since the aforesaid aluminum base alloy has a mixed composition of a fine amorphous phase and an aluminum crystalline phase or an aluminum supersaturated solid solution phase, it has high strength and excellent heat resistance.

Further, unlike the conventional aluminum base alloys, in the aforesaid aluminum base alloy, since the amorphous phase can be formed without using expensive high-active rare-earth elements such as Y and Ce, the specific gravity can be reduced and therefore the specific strength can be prevented from becoming low.

An aluminum base alloy according to a second aspect of the present invention is obtained by cooling a molten alloy at a cooling speed of $1\times10^5$ to $1\times10^7$ K/sec, in which the molten alloy is expressed by a general formula of $Al_{bal}Q1_aQ2_bP1_c$ where Q1 is one or two or more kinds of elements selected from Mn, Cr, V, and Li, Q2 is one or two or more kinds of elements selected from Fe, Mo, Nb, and Cu, P1 is one or two or more kinds of elements selected from Ti, Co, Zr, Si, Ni, Ge, Ca, Sr, Ba, and W, and a, b, and c are atom percents being positive numbers satisfying the relationships of $1\leqq a\leqq 7$, $1\leqq b\leqq 7$, $1\leqq c\leqq 10$, and $c\geqq 0.75(a+b)$; and the aluminum base alloy is composed of a mixed composition of a fine amorphous phase and an aluminum crystalline phase or a supersaturated solid solution phase of aluminum.

Such an aluminum base alloy may be composed of only a single phase of an amorphous phase.

In such an aluminum base alloy, by regulating a of Q1 and b of Q2 so as to satisfy the relationships of $1\leqq a\leqq 7$ and $1\leqq b\leqq 7$, the amorphous phase is more preferentially formed than the quasi-crystalline phase. In this aluminum base alloy, by preferentially forming the amorphous phase, crystallization of the crystalline phase is suppressed.

In this aluminum base alloy, by regulating c of P1 so as to satisfy the relationship of $1\leqq c\leqq 10$, the supercooled state of the molten alloy is stabilized, and crystallization of the crystalline phase is suppressed.

In this aluminum base alloy, by regulating a of Q1, b of Q2, and c of P1 so as to satisfy the relationship of $c\geqq 0.75(a+b)$, the amorphous phase can be more preferentially formed than the quasicrystalline phase.

In this aluminum base alloy, it is preferred that a, b, and c are positive numbers satisfying the relationship of $3\leqq(a+b+c)\leqq 14$.

In this aluminum base alloy, by satisfying $3\leqq(a+b+c)\leqq 14$, the amount of solute elements with high specific gravities is small, so that the specific strength of the aluminum base alloy is further improved.

DETAILED DESCRIPTION OF PREFERRED EMBODIMENT(S)

<<Composition of Aluminum Base Alloy>>

Figure 1:
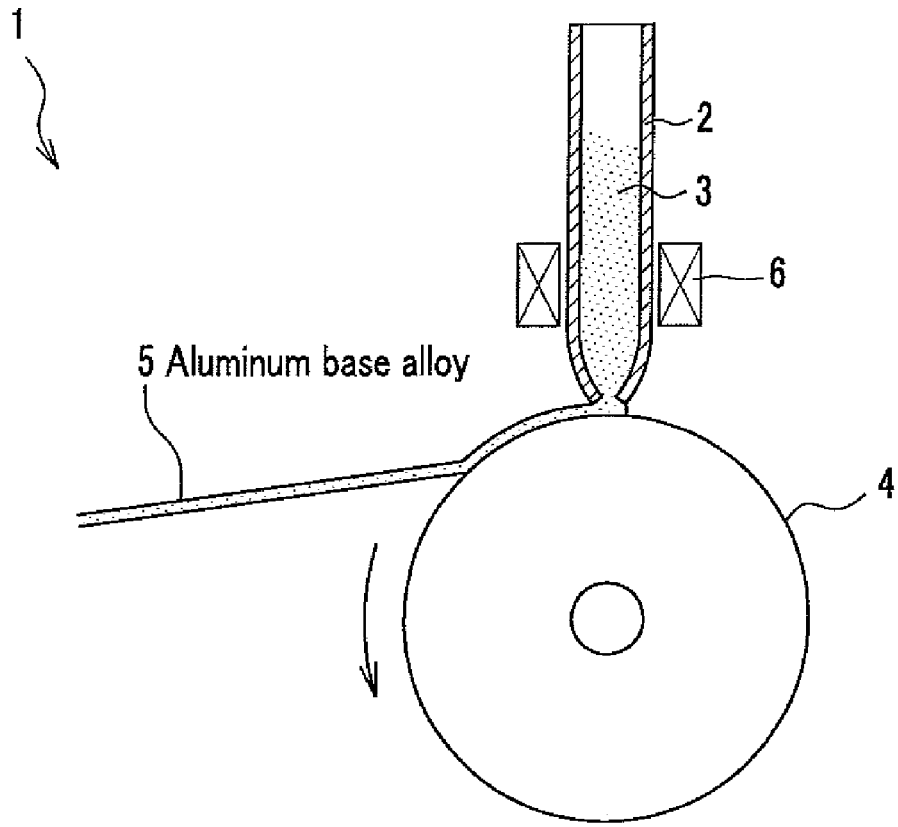
FIG. 1 is a side view of the single-roller liquid rapid quenching apparatus used for producing the aluminum base alloys of the Examples.

The aluminum base alloy of the embodiment is an alloy obtained by supercooling a molten alloy composed mainly of aluminum.

The aluminum base alloy of this embodiment has an amorphous phase more preferentially formed than a quasicrystalline phase by setting the relative proportions of components of the aluminum base alloy to predetermined ranges described later while containing the element Q1 described later capable of forming the quasicrystalline phase. Specifically, the aluminum base alloy of this embodiment is composed of a mixed composition of a fine amorphous base and an aluminum crystalline phase or an aluminum supersaturated solid solution phase, or a single phase of only an amorphous phase although details will be described later. In other words, the aluminum base alloy of this embodiment has a non-quasicrystalline-phase-containing composition that contains substantially no quasicrystalline phase. Herein, "contains substantially no quasicrystalline phase" means that no quasicrystalline phase is observed in an analysis using X-ray diffraction.

Hereinafter, the composition of the aluminum base alloy and the crystal structure of the aluminum base alloy will be described in order.

<Composition of Aluminum Base Alloy>

The aluminum base alloy of this embodiment composed mainly of aluminum is expressed by the same general formula (1) as the molten alloy as follows;

$$Al_{bal}Q1_aQ2_bP1_c \quad (1)$$

This aluminum base alloy contains an element Q1, an element Q2, an element P1, and aluminum as a residual (bal: balance) other than the element Q1, element Q2, and element P1. The content of the element Q1, element Q2, and element P1 are: a atom % Q1, b atom % Q2 and c atom % P1.

[Element Q1]

The element Q1 is added to the molten alloy composed mainly of aluminum, and by supercooling this molten alloy, the element Q1 can be combined with aluminum and form a quasicrystalline phase in the aluminum base alloy. Although the element Q1 can form a quasicrystalline phase, it forms an amorphous phase more preferentially than the quasicrystalline phase under predetermined conditions described later. By combining the element Q1 with the element Q2, an amorphous phase can be produced with a low solute amount, namely, with a small amount of elements, and the thermal stability of the alloy composition of the aluminum base alloy can be improved. Specifically, the element Q1 is one kind or two or more kinds of elements selected from Mn, Cr, V, and Li. The element Q1 can form basic clusters having an icosahedral structure (or a decagonal structure) under predetermined conditions described later.

[Element Q2]

By solving the element Q2 into quasicrystals produced from aluminum and the element Q1, the quasicrystals are easily produced and the thermal stability is improved. In other words, the element Q2 aids formation of quasicrystals from the element Q1. However, this element Q2 aids formation of an amorphous phase when the element Q1 forms the amorphous phase more preferentially than the quasicrystalline phase under the predetermined conditions described later. Specifically, the element Q2 is one or two or more kinds of elements selected from Fe, Mo, Nb, and Cu.

[Element P1]

The element P1 stabilizes a supercooled state of the molten alloy when the molten alloy is supercooled. In addition, the element P1 has a function of suppressing crystallization of a crystalline phase to a state where the degree of supercooling in a low-temperature range is high. As a result, even when the crystalline phase is crystallized, the crystalline phase is finely dispersed in the aluminum base alloy. Specifically, the element P1 is one or two or more kinds of elements selected from Ti, Co, Zr, Si, Ni, Ge, Ca, Sr, Ba, and W.

[Proportions (atom %) of element Q1, element Q2 and element P1]

In the general formula (1), the "a (atom %)" of the element Q1 regulates amorphous phase forming ability to suppress crystallization of a crystal phase, and is a positive number satisfying $1 \leqq a \leqq 7$. If the "a atom %" is less than 1 atom %, the amorphous phase forming ability will be not enough and the crystalline phase crystallization suppressing effect will be insufficient. As a result, strength enhancement of the aluminum base alloy may not be expected. If the "a atom %" is more than 7 atom %, a quasicrystalline phase is preferentially crystallized. As a result, the dispersed amount of quasicrystals may become excessive and the toughness of the aluminum base alloy may lower.

In the general formula (1), the "b (atom %)" of the element Q2 regulates the amorphous phase forming ability to suppress crystallization of a crystal phase similarly to the "a (atom %)" of the element Q1, and is a positive number satisfying $1 \leqq b \leqq 7$. If the "b atom %" is less than 1 atom %, the amorphous phase forming ability is deficient and the crystalline phase crystallization suppressing effect is insufficient. As a result, strength enhancement of the aluminum base alloy may not be expected. If the "b atom %" is more than 7 atom %, a quasicrystalline phase is preferentially crystallized. As a result, the dispersed amount of quasicrystals may become excessive, and the toughness of the aluminum base alloy may lower.

In the general formula (1), the "c (atom %)" of the element P1 regulates the degree of stability of the supercooled state of the aluminum base alloy, and is a positive number satisfying $1 \leqq c \leqq 10$. If the "c atom e" is less than 1 atom %, the supercooled state becomes unstable and crystallization of the crystalline phase is promoted. As a result, the mechanical properties of the obtained aluminum base alloy may be deteriorated. If the "c atom %" is more than 10 atom %, the degree of stability of the supercooled state will increase, however the specific gravity of the obtained aluminum base alloy will increase. As a result, the specific strength of the aluminum base alloy may lower.

The "a (atom %)", the "b (atom %)", and the "c (atom %)" are positive numbers satisfying the relationship of $c \geqq 0.75(a+b)$. The molten alloy containing the "a (atom %)", the "b atom %)" and the "c (atom %)" regulated so as to satisfy the above-described relationships can form the amorphous phase more preferentially than the quasicrystalline phase. If the "a (atom %)", the "b (atom %)", and the "c (atom %)" satisfy a relationship of $c<0.75(a+b)$, the quasicrystalline forming ability of the molten alloy will become high in the balance, and quasicrystals will be preferentially crystallized during cooling.

It is preferred that the "a (atom %)", the "b (atom %)" and the "c (atom %)" are positive numbers satisfying the relationship of $3 \leqq (a+b+c) \leqq 14$. By satisfying this range, the amount of solute elements whose specific gravities are greater than that of aluminum, that is, the amount of the elements Q1, Q2, and P1 becomes smaller, and the specific strength of the obtained aluminum base alloy is improved.

<Crystal Structure of Aluminum Base Alloy>

Next, a crystal structure of the aluminum base alloy of the present embodiment will be described.

The aluminum base alloy of this embodiment is composed of, as described above, a mixed composition of a fine amorphous phase and an aluminum crystalline phase or an aluminum supersaturated solid solution phase, or a single phase of only an amorphous phase.

The aluminum base alloy of this embodiment is obtained by supercooling a molten alloy composed mainly of aluminum as described above. To obtain a structure containing an amorphous phase, the aluminum base alloy of this embodiment is obtained by stabilizing the supercooled state of the molten alloy and setting a state where the amorphous phase, which is more nonequilibrium than the equilibrium crystalline phase, is easily formed. In other words, in order to suppress the crystallization reaction of the crystal phase, the aluminum base alloy of the present embodiment is obtained by increasing the metastability of the liquid phase and solid phase containing the elements Q1, Q2, and P1, suppressing transformation into an equilibrium phase at a high temperature, and causing crystallization reaction in a state where the degree of supercooling in a low-temperature range is as high as possible.

The volume fraction of the amorphous phase is preferably 50% or more with respect to the whole volume of the aluminum base alloy in consideration of the balance between the strength and the ductility of the aluminum base alloy. If the volume fraction of the amorphous phase is less than 50%, strength enhancement by the amorphous phase may be insufficient. The volume fraction of this amorphous phase is appropriately controlled by adjusting the amounts of the solute elements (Q1, Q2, and P1) or adjusting the cooling speed at the production stage of the aluminum base alloy described later.

The average particle size of crystals of the crystalline phase in the composition of the aluminum base alloy is preferably not more than 1000 nanometers. If this average particle size is larger than 1000 nanometers, strength enhancement of the aluminum base alloy may not be expected.

<<Method for Producing Aluminum Base Alloy>>

Next, a method for producing the aluminum base alloy of this embodiment will be described.

The aluminum base alloy of this embodiment can be obtained from the molten alloy having the composition of the general formula (1) by using a production method such as a liquid rapid quenching method such as a single-roller method, a double-roller method, various atomizing methods, or a spraying method, a sputtering method, a mechanical alloying method, or a mechanical grinding method.

In these production methods, the cooling speed of the molten alloy is set to $1\times10^5$ to $1\times10^7$ K/sec.

By appropriately adjusting the production conditions such as the amounts of the solute elements, the cooling speed of the molten alloy, the heating and processing temperatures and processing degree of a laminate, the dispersed states of the amorphous phase and the fine crystalline phase can be controlled in the aluminum base alloy. In other words, by appropriately controlling the production conditions, an aluminum base alloy with desired properties in strength, ductility, and heat resistance can be obtained.

By performing a X-ray diffraction analysis, it can be confirmed that whether the obtained aluminum base alloy has a single-phase composition composed of an amorphous phase or has a mixed composition of an amorphous phase and a fine crystalline phase. At this time, if the alloy has the single-phase composition, the diffraction pattern will be a halo pattern, and if the alloy has the mixed composition, the diffraction pattern will be a composite pattern of a halo pattern and a diffraction peak caused by the fine crystalline phase.

The amorphous phase is decomposed into a crystalline phase by heating at a temperature not less than a crystallization temperature. By using this decomposition, the structure of the mixed composition, that is, the ratios of the amorphous phase and the crystalline phase can be controlled.

<Advantages of Aluminum Base Alloy>

According to the aluminum base alloy of the present embodiment described above, the following advantages can be obtained.

Since the aluminum base alloy is composed of a mixed composition of a fine amorphous phase and an aluminum crystalline phase or an aluminum supersaturated solid solution phase, or composed of a single phase of only an amorphous phase, not only high strength but also excellent heat resistance can be obtained.

Further, in the case where the aluminum base alloy is composed of a single phase of only an amorphous phase, since there is no crystal grain boundary, the surface thereof is very smooth. As a result, such a aluminum base alloy can be preferably used as an electronic material or a corrosion-resistant material.

Further, since the aluminum base alloy contains no expensive rare-earth metals, cost can be reduced.

Since the aluminum base alloy contains no high-active rare-earth elements such as Y and Ce, a passive film on the surface is not uneven, and corrosion does not progress. In other words, in the case where the aluminum base alloy contains high-active rare-earth elements, due to their activeness, the passive film on the surface of the aluminum base alloy will become uneven, and corrosion tends to progress from the uneven portion to the inside. However, the aluminum base alloy of the present embodiment does not cause such unevenness.

Further, since the aluminum base alloy does not contain elements with high specific gravities, there is no concern that the specific strength of the aluminum base alloy will become low.

EXAMPLES

Hereinafter, the present invention will be described in more detail based on the following examples.

Examples 1 Through 23 and Comparative Examples 1 and 2

(1-1) Preparation of a Thin Band-Like Aluminum Base Alloy

In Examples 1 through 23 and Comparative examples 1 and 2, the molten alloys were prepared by melting mother alloys with an arc melting furnace, the melting mother alloys being expressed by the following general formula:

$$Al_{bal}Q1_aQ2_bP1c \quad (1)$$

In the general formula (1), Q1 indicates an element capable of forming a quasicrystalline phase, Q2 indicates an element which aids formation of quasicrystals, and P1 indicates an element which stabilizes a supercooled state of a molten alloy and delays crystallization of a crystalline phase. Also, in the general formula (1), the proportions (atom %) of the elements is regulated by "a", "b", and "c" shown in Tables 1 through 3 described below. In Table 1 through Table 3, the values of c/(a+b) are also shown.

Aluminum base alloys were made by supplying such alloys to a single-roller liquid rapid quenching apparatus. FIG. 1 is a side view of the single-roller liquid rapid quenching apparatus used for producing the aluminum base alloys of Examples. As shown in FIG. 1, the single-roller liquid rapid quenching apparatus has a quenching roller 4 made of pure copper and having a diameter of 200 millimeters. The rotation speed of the quenching roller 4 was set to 4000 rpm, and the roller is set in an Ar atmosphere of 0.133 Pa ($1\times10^{-3}$ Torr) or less.

In this single-roller liquid rapid quenching apparatus 1, a molten alloy 3 is supplied to a quartz glass-made nozzle 2. The quartz glass-made nozzle 2 is provided with a high-frequency heating coil 6 so as to surround the lower side of the nozzle. An outlet provided at the lower end of the quartz glass-made nozzle 2 is disposed in proximity to the outer peripheral surface of the pure copper-made quenching roller 4. By rapidly quenching and solidifying the molten alloy 3 supplied to the rotating pure copper-made quenching roller 4 from the quartz glass-made nozzle 2, a thin band-like (having a ribbon shape of 20 μm in thickness and 1.5 mm in width) aluminum base alloy 5 is produced. The cooling speed of the aluminum base alloy was set to about $1\times10^7$ K/sec.

TABLE 1

| | Proportions [Atom %] | | | | Hardness | Tx | | Density | |
|---|---|---|---|---|---|---|---|---|---|
| | Al | Q1 = a | Q2 = b | P1 = c | [Hv] | [° C.] | Structure | [g/cm³] | c/(a + b) |
| Example 1 | Residual | Cr = 1.96 | Fe = 2.94 | Ti = 1.96<br>Co = 2 | 384 | 373 | fcc-Al<br>Amo | 2.996 | 0.80816327 |
| Example 2 | Residual | Cr = 1.94 | Fe = 2.91 | Ti = 1.94<br>Co = 3 | 413 | 362 | Amo | 3.01 | 1.0185567 |
| Example 3 | Residual | Cr = 1.92 | Fe = 2.88 | Ti = 1.92<br>Co = 4 | 417 | 362 | Amo | 3.078 | 1.23333333 |
| Example 4 | Residual | Cr = 1.9 | Fe = 2.88 | Ti = 1.9<br>Co = 5 | 446 | 374 | Amo | 3.119 | 1.44351464 |
| Example 5 | Residual | Cr = 1.96 | Fe = 2.94 | Ti = 1.96<br>Ni = 2 | 460 | 383 | fcc-Al<br>Amo | 2.996 | 0.80816327 |
| Example 6 | Residual | Cr = 1.94 | Fe = 2.91 | Ti = 1.94<br>Ni = 3 | 441 | 371 | fcc-Al<br>Amo | 3.037 | 1.0185567 |
| Example 7 | Residual | Cr = 1.94 | Fe = 1.91<br>Nb = 1.0 | Ti = 194<br>Ni = 3 | 452 | 392 | fcc-Al<br>Amo | 3.063 | 1.0185567 |
| Example 8 | Residual | Cr = 1.96 | Fe = 2.94 | Ti = 1.96<br>W = 2 | 525 | 464 | fcc-Al<br>Amo | 3.232 | 0.80816327 |
| Example 9 | Residual | Cr = 1.96 | Fe = 2.94 | Ti = 1.96<br>Zr = 2 | 493 | 395 | fcc-Al<br>Amo | 3.016 | 0.80816327 |

TABLE 2

| | Proportions [Atom %] | | | | Hardness | Tx | | Density | |
|---|---|---|---|---|---|---|---|---|---|
| | Al | Q1 = a | Q2 = b | P1 = c | [Hv] | [° C.] | Structure | [g/cm³] | c/(a + b) |
| Example 10 | Residual | Cr = 1.96 | Fe = 2.94 | Ti = 1.96<br>Si = 2 | 369 | 408 | fcc-Al<br>Amo | 2.901 | 0.80816327 |
| Example 11 | Residual | V = 3.82 | Fe = 1.91 | Co = 4.5 | 443 | 357 | fcc-Al<br>Amo | 3.072 | 0.78534031 |
| Example 12 | Residual | V = 3.82 | Fe = 0.91<br>Cu = 1.0 | Co = 4.5 | 431 | 389 | fcc-Al<br>Amo | 3.08 | 0.78534031 |
| Example 13 | Residual | V = 3.82 | Fe = 1.91 | Ni = 4.5 | 471 | 376 | fcc-Al<br>Amo | 3.072 | 0.78534031 |
| Example 14 | Residual | V = 3.78 | Fe = 1.89 | Ni = 5.5 | 493 | 357 | fcc-Al<br>Amo | 3.113 | 0.97001764 |
| Example 15 | Residual | Mn = 3.82 | Fe = 1.91 | Ni = 4.5 | 538 | 424 | fcc-Al<br>Amo | 3.099 | 0.78534031 |
| Example 16 | Residual | V = 3.82 | Fe = 1.91 | Zr = 4.5 | 429 | 416 | fcc-Al<br>Amo | 3.115 | 0.78534031 |

TABLE 2-continued

| | Proportions [Atom %] | | | | Hardness | Tx | | Density | |
|---|---|---|---|---|---|---|---|---|---|
| | Al | Q1 = a | Q2 = b | P1 = c | [Hv] | [° C.] | Structure | [g/cm$^3$] | c/(a + b) |
| Example 17 | Residual | V = 3.82 | Fe = 1.91 | Nb = 4.5 | 367 | 481 | fcc-Al Amo | 3.168 | 0.78534031 |
| Example 18 | Residual | Cr = 1.96 | Mo = 2.94 | Ti = 1.96 Co = 2 | 451 | 418 | fcc-Al Amo | 3.095 | 0.80816327 |

TABLE 3

| | Proportions [Atom %] | | | | Hardness | Tx | | Density | |
|---|---|---|---|---|---|---|---|---|---|
| | Al | Q1 = a | Q2 = b | P1 = c | [Hv] | [° C.] | Structure | [g/cm$^3$] | c/(a + b) |
| Example 19 | Residual | Cr = 1.96 | Fe = 2.94 | Ti = 1.96 Si = 2 | 562 | 395 | fcc-Al Amo | 2.901 | 0.80816327 |
| Example 20 | Residual | Cr = 1.96 | Fe = 2.94 | Ti = 1.96 Ge = 2 | 579 | 365 | fcc-Al Amo | 2.981 | 0.80816327 |
| Example 21 | Residual | Cr = 1.96 | Fe = 2.94 | Ti = 1.96 Ca = 2 | 440 | 386 | fcc-Al Amo | 2.942 | 0.80816327 |
| Example 22 | Residual | Cr = 1.96 | Fe = 2.94 | Ti = 1.96 Sr = 2 | 521 | 364 | fcc-Al Amo | 2.895 | 0.80816327 |
| Example 23 | Residual | Cr = 1.96 | Fe = 2.94 | Ti = 1.96 Ba = 2 | 495 | 359 | fcc-Al Amo | 2.959 | 0.80816327 |
| Comparative example 1 | | $Al_{80}Fe_{15}La_5$ | | | 268 | 363 | fcc-Al Amo | 3.624 | |
| Comparative example 2 | | $Al_{80}Ni_{10}Ce_{10}$ | | | 408 | 352 | Amo | 3.866 | |

(1-2) Analysis of Aluminum Base Alloy (1-2-1) Crystal Structure

The aluminum base alloys obtained in Examples 1 through 23 and Comparative examples 1 and 2 were analyzed by means of x-ray diffraction. The results are shown in Table 1 through Table 3. In the column of "Structure" in Table 1 through Table 3, an aluminum crystalline phase or an aluminum supersaturated solid solution phase of the aluminum base alloy is abbreviated to "fcc-Al," an amorphous phase is abbreviated to "Amo," and an icosahedral quasicrystalline phase is abbreviated to "QC."

It was confirmed that the aluminum base alloys obtained in Example 1, Examples 5 through 23, and Comparative example 1 had a mixed composition of an aluminum crystalline phase or an aluminum supersaturated solid solution phase and an amorphous phase as shown in Table 1 through Table 3.

It was also confirmed that the aluminum base alloys obtained in Examples 2 through 4 and Comparative example 2 had a single-phase composition of only an amorphous phase as shown in Table 1 and Table 3.

Figure 2:
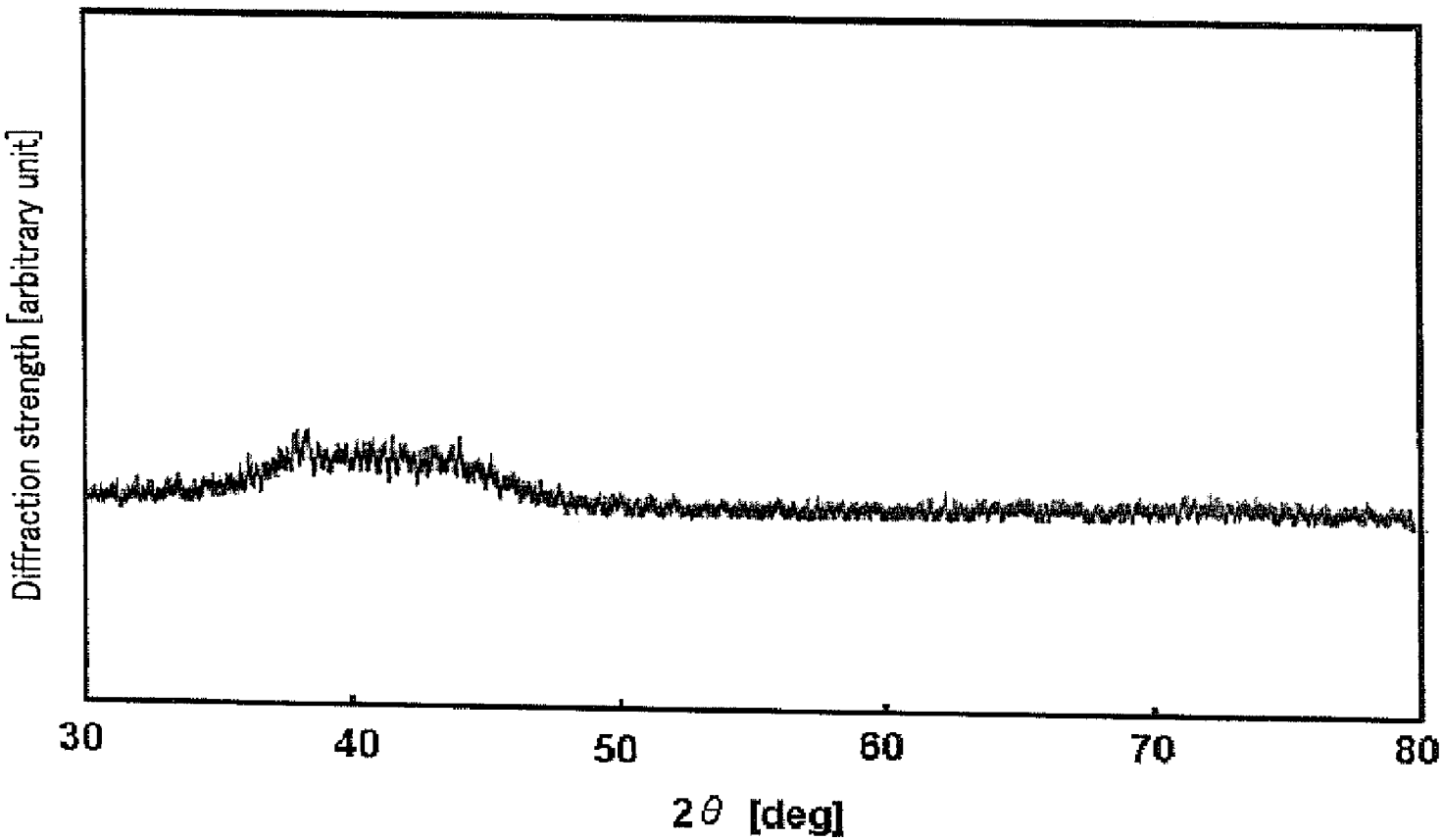
FIG. 2 is a chart of analysis by means of x-ray diffraction of the aluminum base alloy obtained in the Example.
Figure 3A:
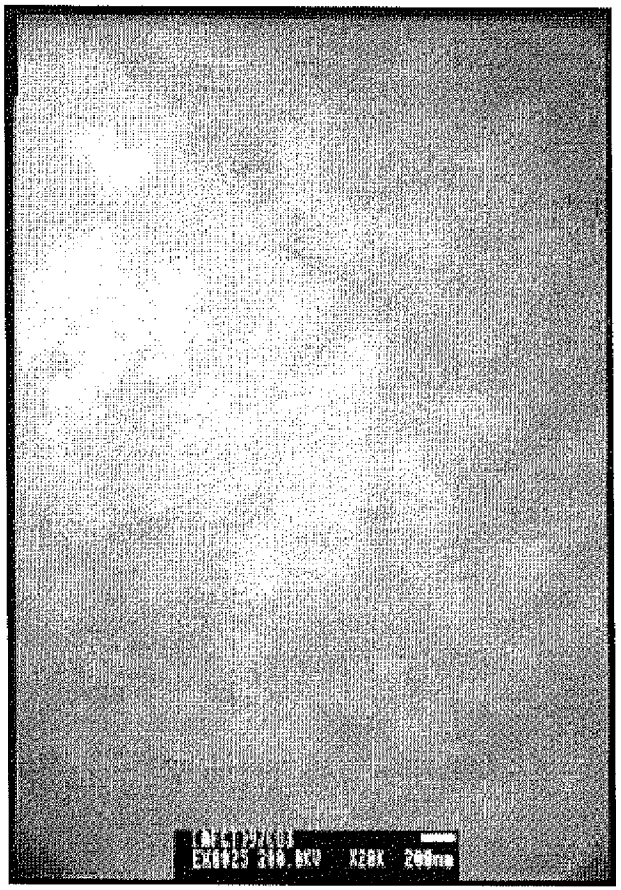
FIG. 3A is an electron microscopic photo of a test specimen cut out from the aluminum base alloy obtained in the Example, taken by a TEM.
Figure 3B:
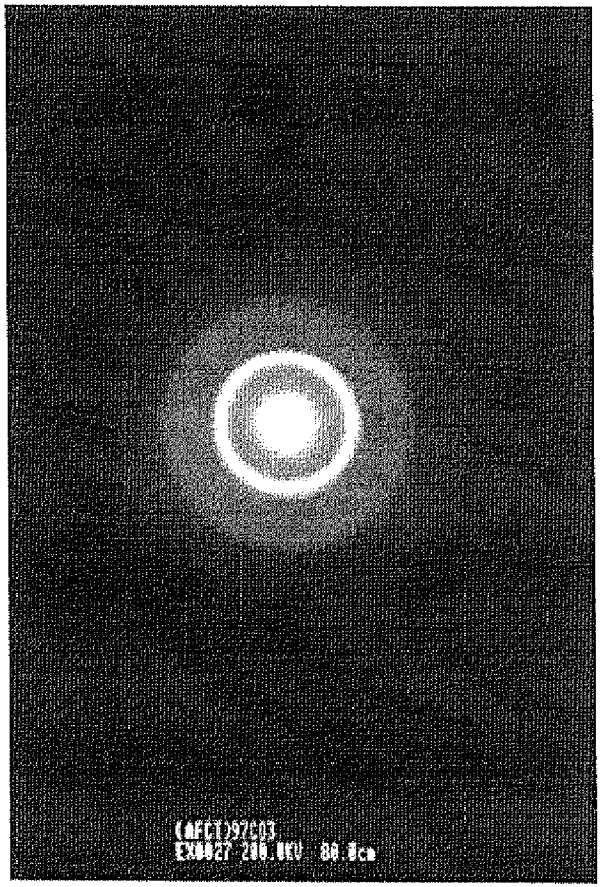
FIG. 3B is a selected-area electron diffraction image photo taken from the composition in FIG. 3A.
Figure 4:
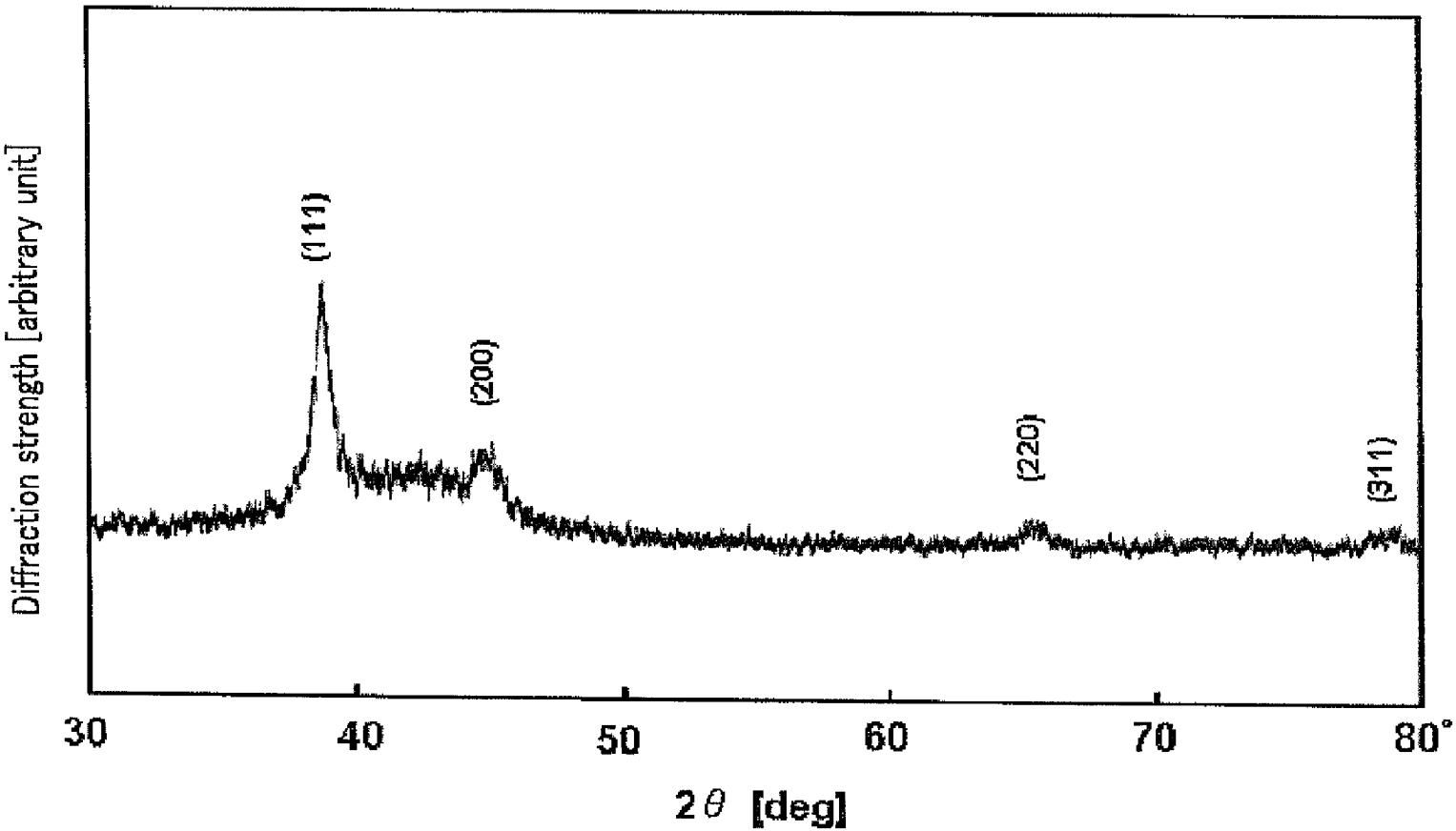
FIG. 4 is a chart of analysis by means of x-ray diffraction of the aluminum base alloy obtained in Example.
Figure 5A:
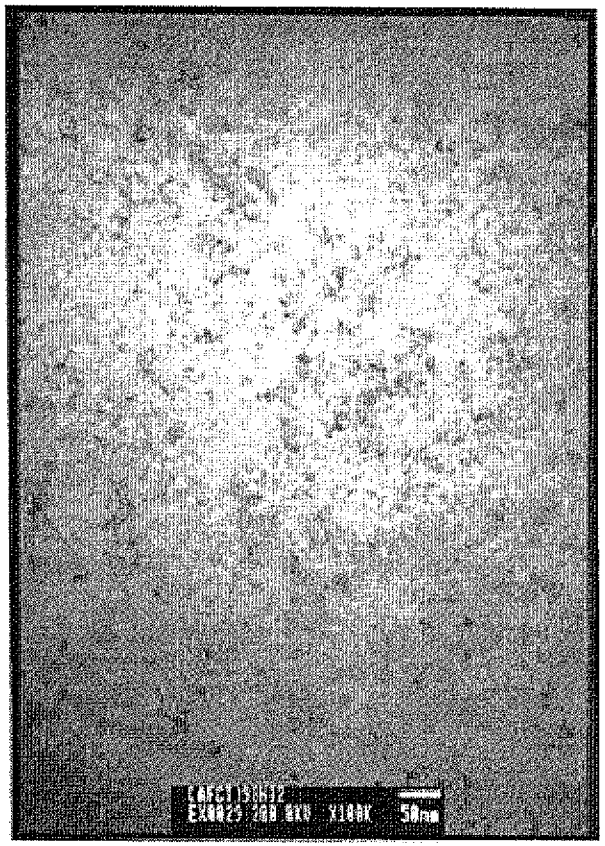
FIG. 5A is an electron microscopic photo of a test specimen cut out from the aluminum base alloy obtained in Example, taken by a TEM.
Figure 5B:
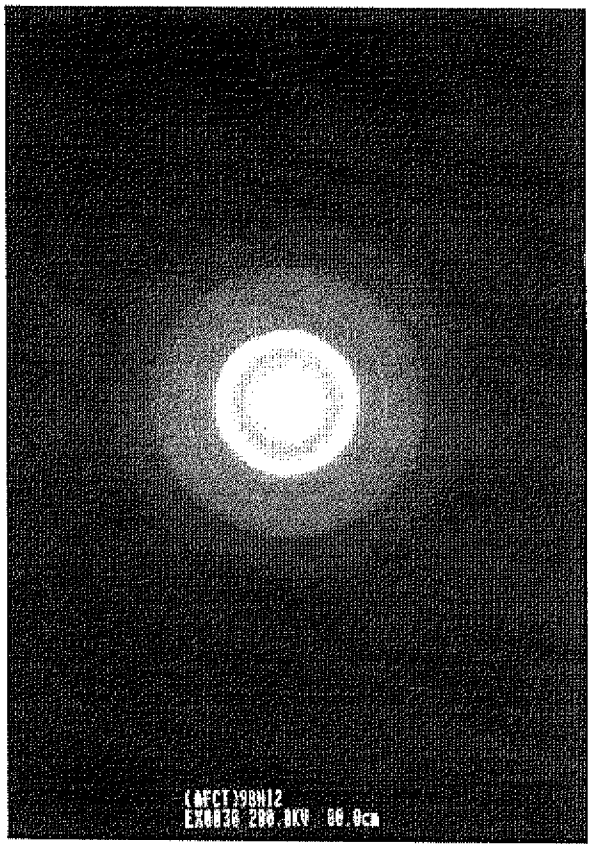
FIG. 5B is a selected-area electron diffraction image photo taken from the composition in FIG. 5A.

FIG. 2 to be referred to herein is a chart of analysis by means of x-ray diffraction of the aluminum base alloy obtained in Example 2. FIG. 3A is an electron microscopic photo of a test specimen cut out from the aluminum base alloy obtained in Example 2, taken by a TEM. FIG. 3B is a selected-area electron diffraction image photo taken from the composition in FIG. 3A. FIG. 4 is a chart of analysis by means of x-ray diffraction of the aluminum base alloy obtained in Example 5. FIG. 5A is an electron microscopic photo of a test specimen cut out from the aluminum base alloy obtained in Example 5, taken by a TEM. FIG. 5B is a selected-area electron diffraction image photo taken from the composition in FIG. 5A.

As shown in FIG. 2, no steep peaks are observed in the chart of the aluminum base alloy obtained in Example 2, and this chart shows a halo pattern unique to an amorphous phase.

As shown in FIG. 3B, the selected-area electron diffraction image of the aluminum base alloy obtained in Example 2 shows a halo pattern unique to an amorphous phase. As shown in FIG. 3A and FIG. 3B, no crystalline phase is observed in the composition of the aluminum base alloy obtained in Example 2, and the figures show that this aluminum base alloy is an alloy composed of a single phase of an amorphous phase.

Then, as shown in FIG. 4, in the chart of the aluminum base alloy obtained in Example 5, peaks of a crystalline phase of aluminum with an fcc structure indicated by (111), (200), (220), and (311) are shown, and these peaks are comparatively broad peaks. This shows that the aluminum base alloy obtained in Example 5 is an alloy composed of a mixed composition of a fine crystalline phase of aluminum with an fcc structure and an amorphous phase.

As shown in FIG. 5A, it was confirmed that the aluminum base alloy obtained in Example 5 had a fine aluminum crystalline phase with an fcc structure which looks like black particles, and an amorphous phase which looks like white background of the black particles. Incidentally, the size of the aluminum crystalline phase was about 20 nm or less, and the volume fraction was about 20%.

As shown in FIG. 5B, the selected-area electron diffraction image of the aluminum base alloy obtained in Example 5 is a result of an overlap of a halo pattern from the amorphous phase and a ring-shaped pattern from the fine aluminum crystalline phase. This shows that the aluminum base alloy obtained in Example 5 is an alloy composed of a mixture composition of a fine aluminum crystalline phase with an fcc structure and an amorphous phase.

(1-2-2) Hardness

The hardness of the aluminum base alloys obtained at room temperature (hereinafter, referred to as "hardness (Hv)") in Examples 1 through 23 and Comparative examples 1 and 2 were measured with a micro Vickers hardness tester under a 25 g load. The results are shown in Table 1 through Table 3.

(1-2-3) Crystallization Temperature

The crystalline temperatures Tx of the aluminum base alloys obtained in Examples 1 through 23 and Comparative examples 1 and 2 were measured. The crystalline temperature Tx is the first heating peak temperature (amorphous phase decomposition and crystallization temperature) of the differential scanning calorimetric curve when heating at 40 K/min.

(1-2-4) Density

The densities of the aluminum base alloys obtained in Examples 1 through 23 and Comparative examples 1 and 2 were measured according to a determined method. The results are shown in Table 1 through Table 3.

(1-3) Evaluation on Aluminum Base Alloys

As shown in Table 1 through Table 3, the hardnesses (Hv) of the aluminum base alloys obtained in Examples 1 through 23 are about 350 to 500. Considering the fact that the hardness (IIv) of a normal aluminum base alloy is about 50 to 100, it can be known that the aluminum base alloys obtained in Examples 1 through 23 have extremely high hardnesses, and which means the aluminum base alloys have high strength.

The crystalline temperatures (Tx) of the aluminum base alloys obtained in Examples 1 through 23 are 350° C. or more, and which means the aluminum base alloys have excellent heat resistances.

The hardnesses (Hv) of the aluminum base alloys obtained in Examples 1 through 23 containing no rare-earth elements are equivalent to or more than the hardnesses of the aluminum base alloys obtained in Comparative example 1 and Comparative example 2 containing rare-earth elements (La, Ce), and the densities of Examples are lower than the densities of Comparative example 1 and Comparative example 2, so that the aluminum base alloys of these Examples are low in specific gravity. As a result, the specific strengths of the aluminum base alloys obtained in Examples 1 through 23 are higher than the specific strengths of Comparative example 1 and Comparative example 2.

Comparative Examples 3 Through 29

Thin band-like aluminum base alloys were made in the same manner as in Examples 1 through 23 described above from the mother alloys expressed by the general formula (1) with the proportions (atom %) regulated by "a", "b", and "c" shown in Table 4 through Table 6 shown below. In Table 4 through Table 6, the values of c/(a+b) are also shown.

The structures of the obtained aluminum base alloys are shown in Table 4 through Table 6. In the column of "Structure" in Table 4 through Table 6, an aluminum crystalline phase or an aluminum supersaturated solid solution phase of the aluminum base alloy is abbreviated to "fcc-Al," an amorphous phase is abbreviated to "Amo," an icosahedral quasicrystalline phase is abbreviated to "QC.," and an intermetallic compound phase is abbreviated to "IMC".

TABLE 4

| | Proportions [Atom %] | | | | | |
|---|---|---|---|---|---|---|
| | Al | Q1 = a | Q2 = b | P1 = c | Structure | c/(a + b) |
| Comparative example 3 | Residual | Cr = 1.96 | Fe = 2.94<br>Nb = 2.0 | Ti = 1.96 | fcc-Al<br>Amo<br>QC. | 0.284058 |
| Comparative example 4 | Residual | Cr = 1.96 | Fe = 2.94<br>Mo = 2.0 | Ti = 1.96 | fcc-Al<br>Amo<br>QC. | 0.284058 |
| Comparative example 5 | Residual | Cr = 1.98 | Fe = 2.97 | Ti = 1.98<br>Co = 1.0 | fcc-Al<br>Amo<br>QC. | 0.60202 |
| Comparative example 6 | Residual | Cr = 1.98 | Fe = 2.97 | Ti = 1.98<br>Zr = 1.0 | fcc-Al<br>Amo<br>QC. | 0.60202 |
| Comparative example 7 | Residual | V = 3.92 | Fe = 1.96 | Zr = 2.0 | fcc-Al<br>Amo<br>QC. | 0.340138 |
| Comparative example 8 | Residual | V = 3.9 | Fe = 1.95<br>Nb = 2.0 | Ti = 0.5 | fcc-Al<br>Amo<br>IMC | 0.063694 |
| Comparative example 9 | Residual | V = 3.9 | Fe = 1.95<br>Mo = 2.0 | Ti = 0.5 | fcc-Al<br>QC. | 0.063694 |
| Comparative example 10 | Residual | V = 3.94 | Fe = 1.97<br>Nb = 1.0 | Ti = 0.5 | fcc-Al<br>QC.<br>IMC | 0.072359 |
| Comparative example 11 | Residual | V = 3.94 | Fe = 1.97<br>Mo = 1.0 | Ti = 0.5 | fcc-Al<br>QC. | 0.072359 |

TABLE 5

| | Proportions [Atom %] | | | | | |
|---|---|---|---|---|---|---|
| | Al | Q1 = a | Q2 = b | P1 = c | Structure | c/(a + b) |
| Comparative example 12 | Residual | Cr = 2.0 | Fe = 5.0 | Ti = 1.0<br>Zr = 1.0 | fcc-Al<br>QC.<br>IMC | 0.285714 |
| Comparative example 13 | Residual | Cr = 4.0 | Fe = 3.0 | Ti = 1.0<br>Zr = 1.0 | fcc-Al<br>QC. | 0.285714 |
| Comparative example 14 | Residual | Cr = 2.0 | Fe = 5.0 | Co = 1.0<br>Zr = 1.0 | fcc-Al<br>QC.<br>IMC | 0.285714 |
| Comparative example 15 | Residual | Cr = 4.0 | Fe = 3.0 | Co = 1.0<br>Zr = 1.0 | fcc-Al<br>QC.<br>IMC | 0.285714 |
| Comparative example 16 | Residual | Cr = 2.0 | Fe = 5.0 | Ti = 1.0<br>Sr = 1.0 | fcc-Al<br>QC.<br>IMC | 0.285714 |
| Comparative example 17 | Residual | Cr = 4.0 | Fe = 3.0 | Ti = 1.0<br>Si = 1.0 | fcc-Al<br>QC. | 0.285714 |
| Comparative example 18 | Residual | Cr = 2.0 | Fe = 5.0 | Co = 1.0<br>Si = 1.0 | fcc-Al<br>QC.<br>IMC | 0.285714 |
| Comparative example 19 | Residual | Cr = 4.0 | Fe = 3.0 | Co = 1.0<br>Si = 1.0 | fcc-Al<br>QC. | 0.285714 |
| Comparative example 20 | Residual | Cr = 5.0 | Fe = 3.0 | Ti = 1.0<br>Co = 1.0 | fcc-Al<br>QC.<br>IMC | 0.25 |

TABLE 6

| | Proportions [Atom %] | | | | | |
|---|---|---|---|---|---|---|
| | Al | Q1 = a | Q2 = b | P1 = c | Structure | c/(a + b) |
| Comparative example 21 | Residual | Cr = 3.0<br>V = 1.0 | Fe = 3.0 | Ti = 1.0<br>Co = 1.0 | fcc-Al<br>QC. | 0.285714 |
| Comparative example 22 | Residual | Cr = 1.12 | Fe = 2.8 | Ti = 0.56<br>Co = 0.56 | fcc-Al<br>QC.<br>IMC | 0.285714 |
| Comparative example 23 | Residual | Cr = 2.24 | Fe = 1.68 | Ti = 0.56<br>Co = 0.56 | fcc-Al<br>QC.<br>IMC | 0.285714 |
| Comparative example 24 | Residual | Cr = 2.0 | Fe = 3.0 | Ti = 1.0<br>Co = 1.0 | fcc-Al<br>QC.<br>IMC | 0.4 |
| Comparative example 25 | Residual | Cr = 2.0 | Fe = 4.0 | Ti = 1.0<br>Co = 1.0 | fcc-Al<br>QC. | 0.333333 |
| Comparative example 26 | Residual | Cr = 2.0 | Fe = 5.0 | Ti = 1.0<br>Co = 1.0 | fcc-Al<br>QC.<br>IMC | 0.285714 |
| Comparative example 27 | Residual | Cr = 3.0 | Fe = 3.0 | Ti = 1.0<br>Co = 1.0 | fcc-Al<br>QC. | 0.333333 |
| Comparative example 28 | Residual | Cr = 4.0 | Fe = 3.0 | Ti = 1.0<br>Co = 1.0 | fcc-Al<br>QC. | 0.285714 |
| Comparative example 29 | Residual | Cr = 3.0 | Fe = 4.0 | Ti = 1.0<br>Co = 1.0 | fcc-Al<br>QC.<br>IMC | 0.285714 |

Figure 6:
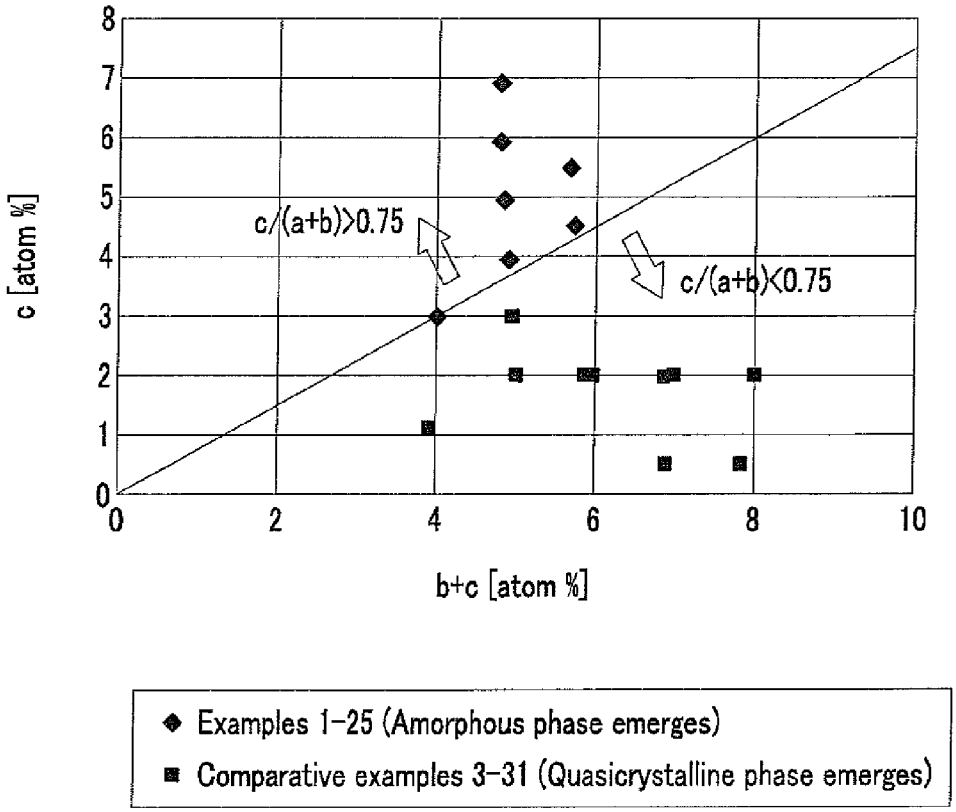
FIG. 6 is a graph showing regions in which an amorphous phase emerges and regions in which a quasicrystalline phase emerges in the aluminum base alloy.

The aluminum base alloys obtained in Comparative examples 3 through 29 are different from the aluminum base alloys obtained in Examples 1 through 23 in that the aluminum base alloys of Comparative examples 3 through 29 contain an icosahedral quasicrystalline phase. FIG. 6 to be referred to herein is a graph showing regions in which an amorphous phase emerges and regions in which a quasicrystalline phase emerges in the aluminum base alloy. This FIG. 6 is a graph in which "c (atom %)" of the general formula (1) is indicated on the vertical axis and "(a+b) (atom %)" is indicated on the horizontal axis, and the emergence regions of the amorphous phase and the quasicrystalline phase (refer to the column of structure in Table 1 through Table 6) in the aluminum base alloys obtained in Examples 1 through 23 and the aluminum base alloys obtained in Comparative examples 3 through 29 are associated with c and (a+b).

As shown in FIG. 6, it was found that the boundary between the amorphous phase emergence region and the quasicrystalline phase emergence region was regulated by a straight line satisfying the relationship of c/(a+b)=0.75. In other words, it was found that in a region satisfying $c \geqq 0.75(a+b)$, an amorphous phase emerged, and in a region satisfying $c < 0.75(a+b)$, a quasicrystalline phase emerged.

Examples 24 and 25 and Comparative Examples 30 and 31

In Examples 24 and 25, thin band-like aluminum base alloys were made in the same manner as in Examples 1 through 23 from mother alloys which were expressed by the general formula (1) and had the proportions (atom %) regulated by "a", "b" and "c" shown in Table 7. Specifically, Example 24 and Comparative example 30 have the same composition, and Example 25 and Comparative example 31 have the same composition. In Comparative examples 30 and 31, thin band-like aluminum base alloys were made in the same manner as in Examples 1 through 23 except that the rotation speed of the pure copper-made quenching roller 4 (see FIG. 1) was set to 1000 rpm, and the cooling speed of the aluminum base alloys was changed to $1\times10^3$ K/sec. In Table 7, the values of c/(a+b) are also shown.

The structures of the obtained aluminum base alloys are shown in Table 7. In the column of "Structure" in Table 7, an aluminum crystalline phase or an aluminum supersaturated solid solution phase of the aluminum base alloy is abbreviated to "fcc-Al," an amorphous phase is abbreviated to "Amo," an icosahedral quasicrystalline phase is abbreviated to "QC.", and an intermetallic compound phase is abbreviated to "IMC."

TABLE 7

| | Proportions [Atom %] | | | | | |
|---|---|---|---|---|---|---|
| | Al | Q1 = a | Q2 = b | P1 = c | Structure | c/(a + b) |
| Example 24 | Residual | Cr = 2.0 | Fe = 2.0 | Ti = 2.0<br>Co = 1.0 | fcc-Al<br>Amo | 0.75 |
| Example 25 | Residual | Cr = 1.0 | Fe = 3.0 | Ti = 2.0<br>Co = 1.0 | fcc-Al<br>Amo | 0.75 |
| Comparative example 30 | Residual | Cr = 2.0 | Fe = 2.0 | Ti = 2.0<br>Co = 1.0 | fcc-Al<br>QC.<br>IMC | 0.75 |
| Comparative example 31 | Residual | Cr = 1.0 | Fe = 3.0 | Ti = 2.0<br>Co = 1.0 | fcc-Al<br>QC.<br>IMC | 0.75 |

As shown in FIG. 7, in Examples 24 and 25, amorphous phases are observed, and no quasicrystalline phase is observed. On the other hand, in Comparative examples 30 and 31, quasicrystals are observed, and no amorphous phase is observed. That is, it was found that an amorphous phase could be crystallized without crystallization of a quasicrystalline phase by changing the cooling speed from $1\times10^3$ K/sec to $1\times10^7$ K/sec even if the molten alloys had the same composition.

What is claimed is:

1. An aluminum base alloy obtained by supercooling a molten alloy composed mainly of aluminum, wherein the molten alloy contains an element Q1 capable of forming a quasicrystalline phase, an element Q2 for aiding formation of the quasicrystals, and an element P1 for stabilizing the supercooled state of the molten alloy and delaying crystallization of the crystalline phase, and the aluminum base alloy consists of non-quasicrystalline-phase-containing composition composed of a mixed composition of a fine amorphous phase and an aluminum crystalline phase or an aluminum supersaturated solid solution phase, or a single phase of only an amorphous phase, wherein the aluminum base alloy has a hardness from about 350 to about 580 Hv, and wherein a volume fraction of the amorphous phase is 50% or more with respect to the whole volume of the aluminum base alloy.

2. An aluminum base alloy obtained by cooling a molten alloy at a cooling speed of $1\times10^5$ to $1\times10^7$ K/sec, wherein:

the molten alloy is expressed by a general formula of $Al_{bal}Q1_aQ2_bP1_c$, where:

Q1 is selected from the group consisting of Mn, Cr, V, and Li,

Q2 is selected from the group consisting of Fe, Mo, Nb, and Cu,

P1 is selected from the group consisting of Ti, Co, Zr, Si, Ni, Ge, Ca, Sr, Ba, and W, and a, b, and c are atomic percents being positive numbers satisfying the relationships of $1 \leqq a \leqq 7$, $1 \leqq b \leqq 7$, $1 \leqq c \leqq 10$, and $c \leqq 0.75(a+b)$; and the aluminum base alloy consists of a non-quasicrystalline-phase-containing composition composed of a mixed composition of a fine amorphous phase and an aluminum crystalline phase or a supersaturated solid solution phase of aluminum, wherein the aluminum base alloy has a hardness from about 350 to about 580 Hv.

3. The aluminum base alloy according to claim 2, wherein a, b, and c in the general formula are positive numbers satisfying the relationship of $3 \leqq (a+b+c) \leqq 14$.

4. An aluminum base alloy obtained by cooling a molten alloy at a cooling speed of $1\times10^5$ to $1\times10^7$ K/sec, wherein:

the molten alloy is expressed by a general formula of $Al_{bal}Q1_aQ2_bP1_c$, where:

Q1 is selected from the group consisting of Mn, Cr, V, and Li,

Q2 is selected from the group consisting of Fe, Mo, Nb, and Cu,

P1 is selected from the group consisting of Ti, Co, Zr, Si, Ni, Ge, Ca, Sr, Ba, and W, and a, b, and c are atomic percents being positive numbers satisfying the relationships of $1 \leqq a \leqq 7$, $1 \leqq b \leqq 7$, $1 \leqq c \leqq 10$, and $c \leqq 0.75(a+b)$; and the aluminum base alloy consists of a non-quasicrystalline-phase-containing composition composed of a single phase of only an amorphous phase, wherein the aluminum base alloy has a hardness from about 350 to about 580 Hv.

5. The aluminum base alloy according to claim 4, wherein a, b, and c in the general formula are positive numbers satisfying the relationship of $3 \leqq (a+b+c) \leqq 14$.

* * * * *